US008087568B2

(12) United States Patent
Weissbrod

(10) Patent No.: US 8,087,568 B2
(45) Date of Patent: Jan. 3, 2012

(54) COLLAPSIBLE CARTON

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 279 days.

(21) Appl. No.: 12/112,433

(22) Filed: Apr. 30, 2008

(65) Prior Publication Data

US 2009/0272790 A1 Nov. 5, 2009

(51) Int. Cl.
*B65D 5/00* (2006.01)
*B65B 43/00* (2006.01)

(52) U.S. Cl. ..... 229/101; 53/396; 229/101.2

(58) Field of Classification Search ..... 229/101, 229/117.01, 101.2
See application file for complete search history.

(56) References Cited

U.S. PATENT DOCUMENTS

| | | | | | |
|---|---|---|---|---|---|
| 2,791,367 | A * | 5/1957 | Mefford | 229/101 |
| 3,280,871 | A * | 10/1966 | Taylor | 190/103 |
| 3,291,373 | A * | 12/1966 | Joyce | 383/120 |
| 3,313,467 | A * | 4/1967 | Anderskow et al. | 229/101 |
| 3,338,407 | A * | 8/1967 | Carlson | 229/101 |
| 5,975,411 | A * | 11/1999 | Windolph, III | 229/101 |
| 6,119,929 | A | 9/2000 | Rose | |
| 6,138,901 | A | 10/2000 | Kim et al. | |
| 6,394,336 | B1 * | 5/2002 | Beneroff et al. | 229/101 |

* cited by examiner

*Primary Examiner* — Nathan J Newhouse
*Assistant Examiner* — Christopher Demeree
(74) *Attorney, Agent, or Firm* — Hahn Loeser & Parks LLP

(57) ABSTRACT

A carton includes scores that create pleats fashioned in the walls of the carton. As weight from subsequently stacked materials impinge on the carton, the side walls collapse in a substantially uniform manner leaving the carton top in tact and substantially level with the bottom of the carton.

17 Claims, 6 Drawing Sheets

COLLAPSIBLE CARTON

TECHNICAL FIELD

The present invention pertains to packaging systems, and more particularly, to cartons having walls that in a uniform manner automatically collapse to a reduced size.

BACKGROUND OF THE INVENTION

Countless products are packaged and shipped to end-users in this country and around the world daily. Many products are placed in crates or boxes filled with packing material to minimize or prevent damage during shipping. Some products are stored and packaged in cartons, which may be sealed to prevent the enclosed items from exposure to ambient conditions. Other products are less sensitive and don't require a hermetic seal. Examples of packaged products may range from edible substances to industrial consumables, like welding electrodes. Cartons are commonly constructed from renewable or recycled material like, for example, corrugated cardboard, which is easy and relatively inexpensive to produce.

In many cases, similarly sized cartons are used to package different quantities of products. Some cartons may therefore contain a particular quantity of material leaving free space within the carton for the products to jostle about during shipment resulting in damage. This also affords the opportunity for stacked cartons to compress or deform. As the contents may not be uniformly distributed, pressure frequently collapses one end of the adjacent carton creating an uneven stacking surface. Cartons higher in the stack are therefore prone to falling and hence damage. Falling cartons also lead to an unsafe working environment. Furthermore, the tilted packaged contents look disorderly and unsightly.

It would be useful to provide a carton that automatically collapses under pressure in a uniform manner. Such a container would maintain a level relationship between upper and lower surfaces of adjacent cartons. A primary purpose of this invention is to provide such a device with its various attendant advantages.

BRIEF SUMMARY

In one embodiment of the present invention, a collapsible carton includes a carton bottom and one or more side walls extending from the carton bottom defining a first maximum carton volume, where the carton is fashioned to automatically collapse under pressure in a substantially uniform manner defining a second smaller carton volume.

In one aspect of the embodiments of the subject invention each of the one or more side walls respectively collapse substantially uniformly from a first height to a second shorter height.

In another aspect of the embodiments of the subject invention, a carton lid is integrally fashioned with respect to the one or more side walls for enclosing the associated contents of the carton.

In yet another aspect of the embodiments of the subject invention, the carton lid comprises major and minor flaps, where at least one of the major or minor flaps includes scores for creating pleats in the carton lid.

In still another aspect of the embodiments of the subject invention, the carton may collapse in discrete volumetric increments.

In even another aspect of the embodiments of the subject invention, the carton is generally polygonal and the one or more side walls are generally planar.

In another aspect of the embodiments of the subject invention, the carton is generally tubular.

In still another aspect of the embodiments of the subject invention, the one or more side walls include at least a first score extending at least partially along the width of the one or more side walls thereby facilitating the collapse of the one or more side walls in a substantially uniform manner.

In yet another aspect of the embodiments of the subject invention, the one or more side walls include a plurality of scores respectively, where the plurality of scores are each substantially parallel with respect to each other and to the carton bottom.

In even yet another aspect of the embodiments of the subject invention, the one or more side walls include a plurality of scores respectively, where the plurality of scores are alternately fashioned on inner and outer surfaces of the carton thereby facilitating collapse of the carton in a pleated fashion.

In still another aspect of the embodiments of the subject invention, the one or more side walls comprise first and second distally opposed side walls; wherein the first side wall includes a score at a predetermined height H with respect to the carton bottom; and, wherein the second side wall includes a score at substantially the same height H with respect to the carton bottom.

In another aspect of the embodiments of the subject invention, the one or more side walls further comprise at least third and fourth distally opposed side walls spaced apart by the first and second side walls; wherein the third side wall includes a score at a predetermined height H1 with respect to the carton bottom and wherein the fourth side wall includes a score at substantially the same height H1 with respect to the carton bottom; and, wherein the H1 is less than H.

In another embodiment of the subject invention a system of palletized cartons stacked in multiple layers, includes a pallet base, a first collapsible carton stacked onto the pallet base having at least a first pleat, the first collapsible carton having a first characteristic height and an upper surface substantially parallel to the pallet base, and a second collapsible carton, and when the second collapsible carton is placed in stacking relationship with the first collapsible carton, the first collapsible carton uniformly collapses to a second shorter height, and wherein the upper surface remains substantially parallel to the pallet base.

In another aspect of the embodiments of the subject invention, the distance between the first characteristic height and the second shorter height is substantially in the range between 0 and 1 inch.

DETAILED DESCRIPTION OF THE INVENTION

Figure 1:
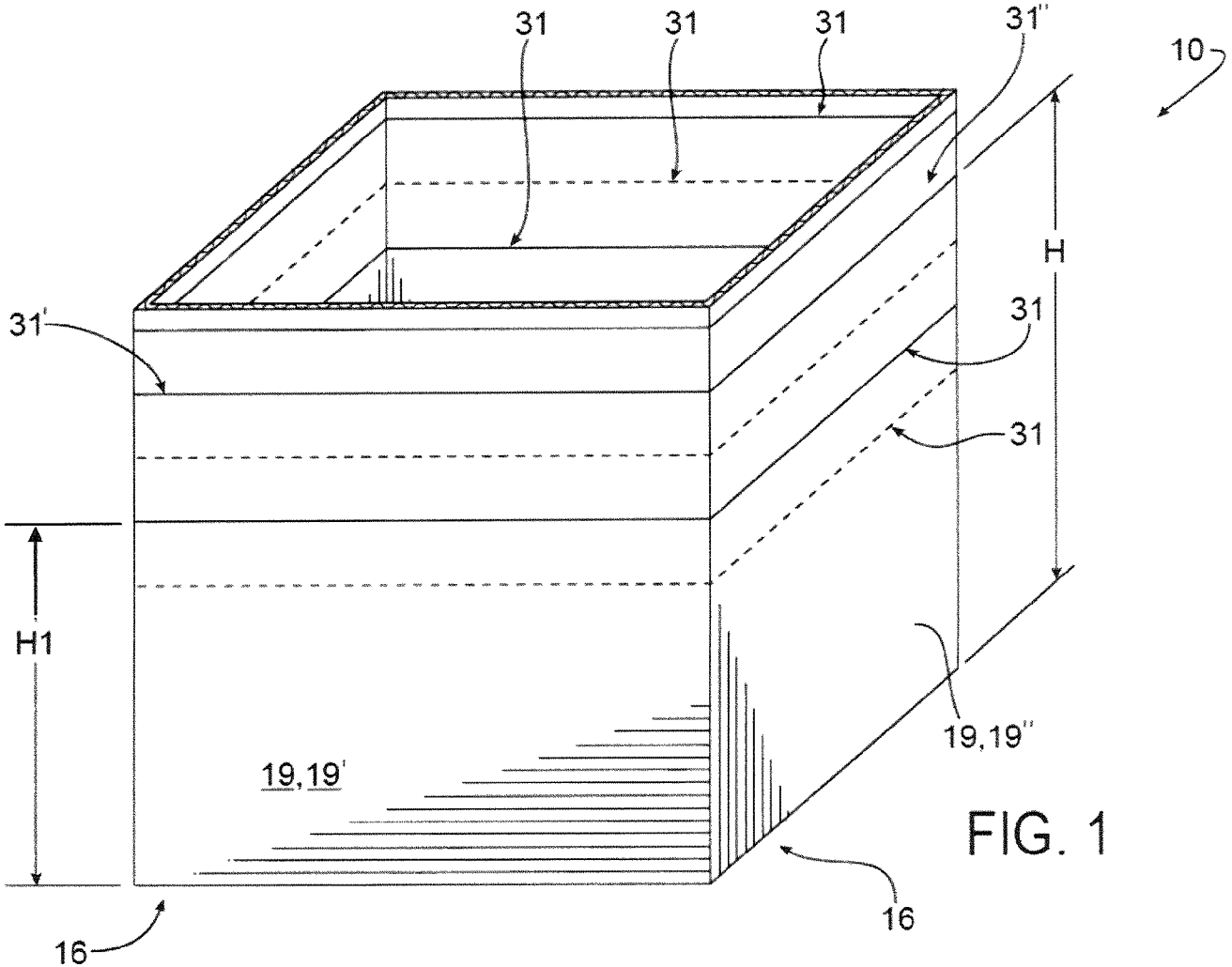
FIG. 1 is a perspective view of a carton having pleats according to the embodiments of the subject invention.

Referring now to the drawings wherein the showings are for purposes of illustrating embodiments of the invention only and not for purposes of limiting the same, FIG. 1 shows a carton depicted generally at 10. The carton 10 may be configured for storing a plurality of manufactured articles 13 for shipment to an end-user. Examples of such articles 13 may include industrial consumables, like welding electrodes. The conglomerate weight of the articles 13 may be relatively heavy with respect its packaging. As such, the carton 10 may be constructed from material having sufficient rigidity for storing such articles 13, but cost effective to use. Cardboard is just one type of material that may be utilized to construct the carton 10. Other types of materials may include polymer substances or other fibrous material. Still any type of material may be used as is appropriate for use with the embodiments of the present invention.

Figure 2:
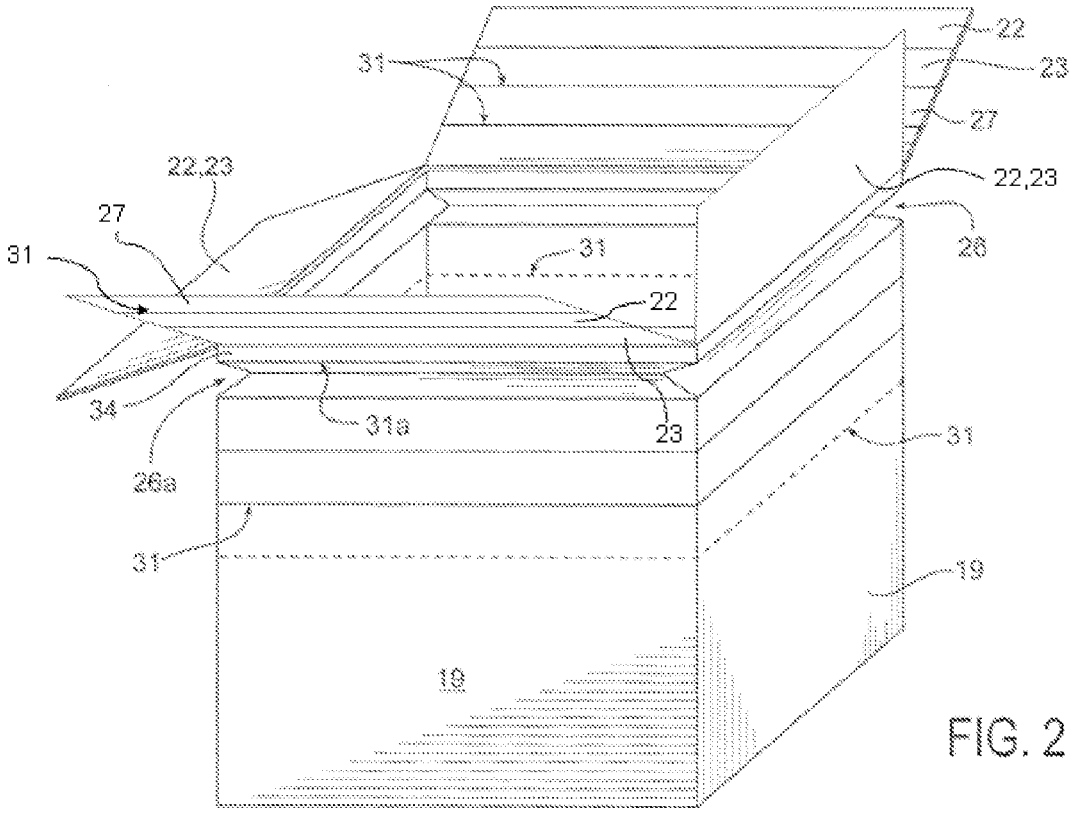
FIG. 2 is a perspective view of a carton having pleats according to the embodiments of the subject invention.
Figure 5:
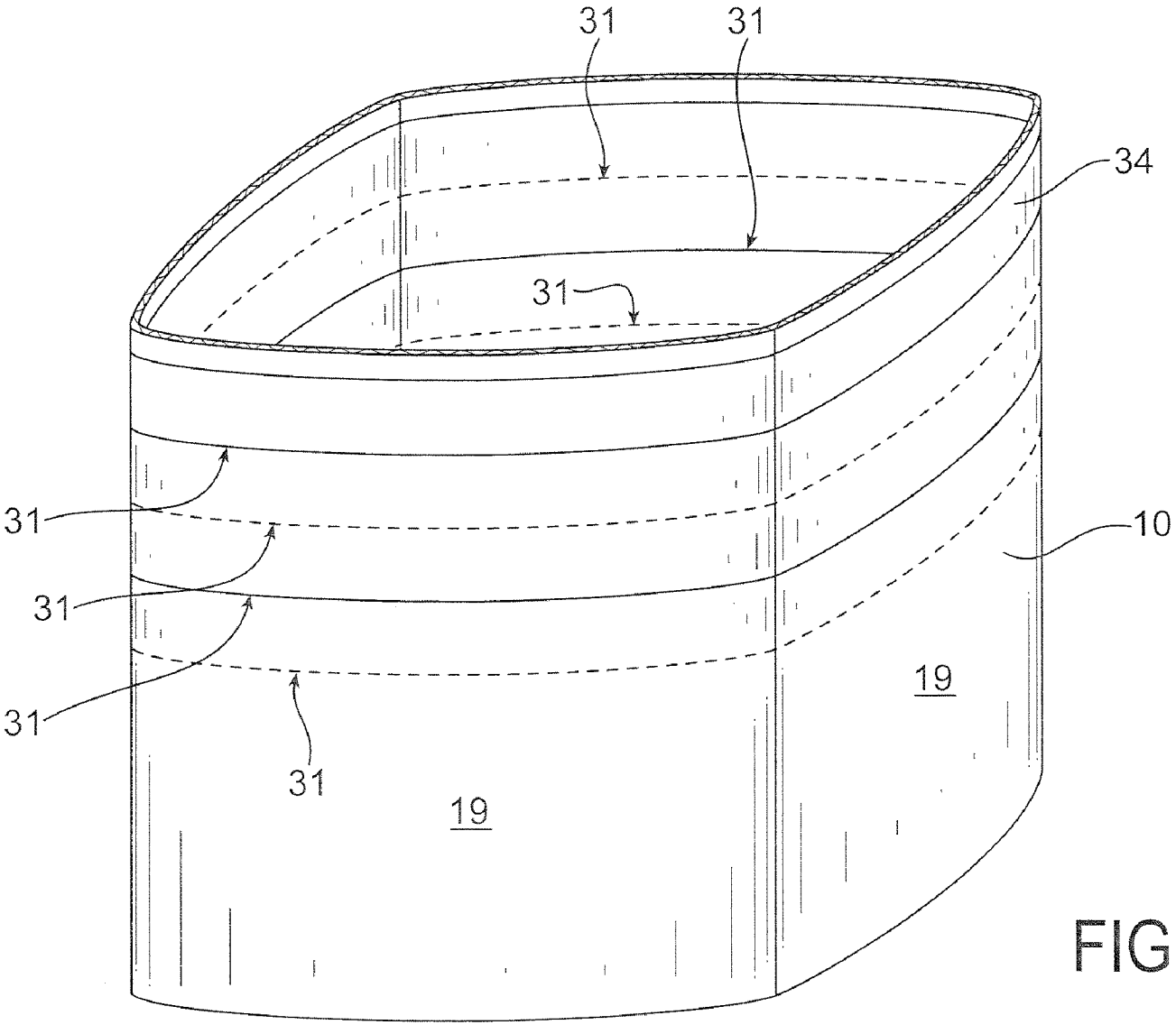
FIG. 5 is a perspective view of a carton drum having pleats according to the embodiments of the subject invention.

With reference to FIGS. 1 and 5, the carton 10 may be used to package varying quantities of articles 13. The carton 10 may include a bottom panel 16 or base, also referred to herein as the carton bottom. The bottom panel 16 may be fabricated as a single contiguously formed sheet of material. However, other configurations are contemplated that include multiple panel sections assembled together to form the bottom panel 16. One or more side walls 19 may extend from the bottom panel 16. In one embodiment, the carton 10 may be generally polygonal in configuration. More specifically, the carton 10 may be boxlike; that is to say rectangular. The width and height of the side walls 19 define a first maximum volume of the carton 10. In one embodiment, the side walls 19 of the carton 10 may uniformly compress to a second smaller volume, as will be discussed further below. Additionally, the side walls 19 may be integrally fashioned with the bottom panel 16. Creases in the material may characterize the folding joint between the bottom panel 16 and the side walls 19. It is noted here that the embodiments of the subject invention are not limited to planar side walls 19. Curved side walls 19 are also contemplated, which if course may be arranged to form a drum. The carton 10 may further include a lid 22. The lid may be comprised of multiple lid panels 23 each extended respectively from one of the side walls 19. As such, the lid panels 23 may be integrally fashioned with respect to the side walls 19. When filled with product, i.e. articles 13, the lid panels 23 may be folded over and affixed together or fastened in place. It is noted here that FIG. 1 shows a carton 10 without lid panels 23 for illustrative clarity only. Similarly, FIG. 2 shows only two lid panels 23. However, it will be understood that in the current embodiment, the lid 22 includes four lid panels 23, comprising two minor lid panels and two major lid panels, extending from respective sides of the carton 10.

With continued reference to FIG. 1 and now also to FIG. 2, the carton 10 may include a series of pleats 26 fashioned in various sections of the carton 10. In one embodiment, the side walls 19 may be fashioned with pleats 26 that cause the side walls 19 to fold in upon itself thereby reducing the volume of the carton 10. The pleats 26 may be created by scoring the surfaces of the carton 10, and in particular the side walls 19. By scoring it is meant that the material making up the side walls 19 is cut or etched to slightly weaken the material at that location. It follows that the scored carton 10 is therefore prone to bending or folding in a precise manner and controlled direction. Scoring may extend intermittently or continuously along one or more dimensions of the side walls 19. Additionally, the amount of the scoring, i.e. depth or width, may vary depending on the configuration and material constructing the carton 10. Of course, any manner of scoring the carton material may be chosen with sound engineering judgment. Other portions of the carton 10 may also be scored including but not limited to the lid panels 23 to be discussed in detail below.

Figure 3:
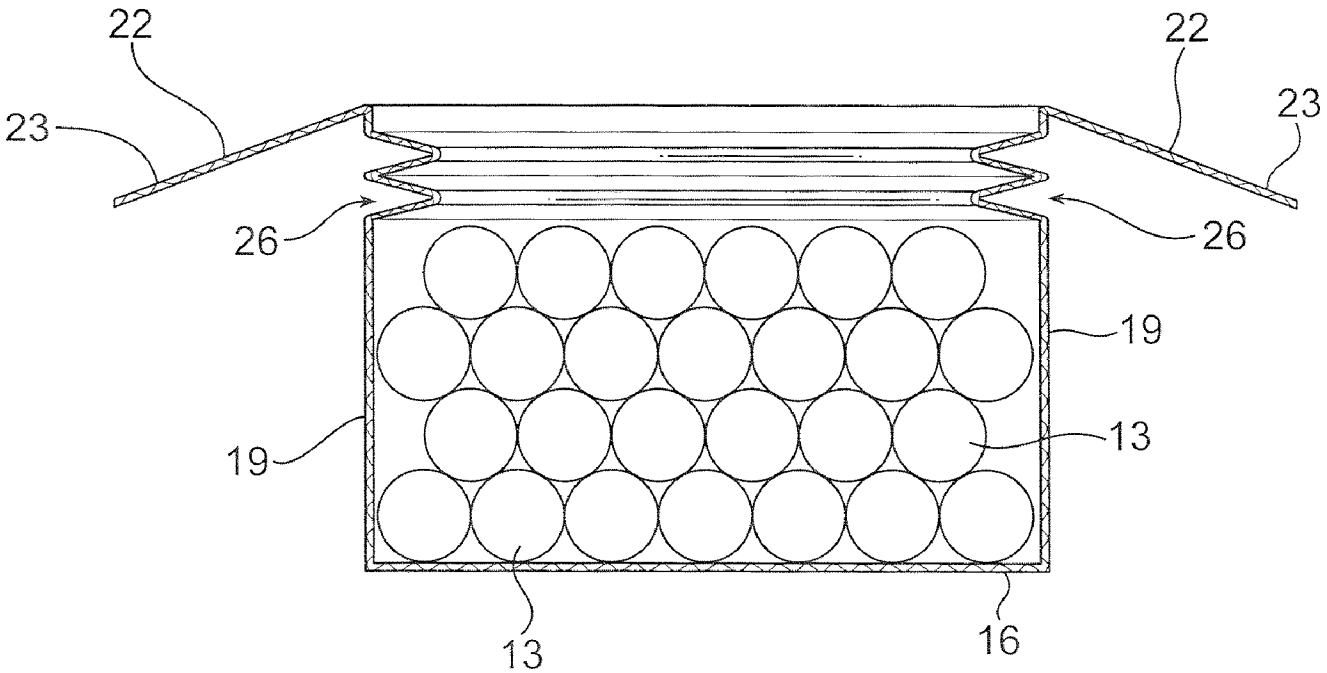
FIG. 3 is a cutaway side view of a carton having pleats according to the embodiments of the subject invention.

With reference to FIGS. 1 through 3, scores 31 in the carton material may be fashioned at various positions on the side walls 19 and lid 22. In one embodiment, the scores 31 may be fashioned horizontally around the circumference of the side walls 19. In other words, each individual side wall 19 may include its own score 31, parallel to the carton bottom, for creating pleats as mentioned above. Multiple scores 31 may be fashioned consecutively down the side walls 19 and may be generally parallel to each other and to bottom panel 16. However, angled and/or skewed scores 31 may be implemented without departing from the intended scope of coverage of the embodiments of the subject invention. The scores 31 may also be fashioned in an alternating manner on both interior and exterior sides of the side walls 19. That is to say that one score 31 may be formed on the inside of the side wall 19, while the next is formed on the outside. In this manner, the pleats 26 will compress cleanly in a predefined manner. It will be understood by persons of ordinary skill in the art that scoring material on a particular side causes the material to bend in that direction. Additionally, for each adjacent side wall 19, it is contemplated that the scores 31 may be respectively offset vertically up or down so as not to overlap the pleats 26. In this way, the pleat 26 of one side wall 19 will be offset and not interfere with the pleat 26 from an adjacent side wall 19. As such, a height H is defined as the distance from the bottom panel 16 to the score 31' of a first side wall 19'. And a height H1 is defined as the distance from the bottom panel 16 to the score 31" of a second adjacent side wall 19", where in one embodiment H1 is less than H. Alternatively, H1 may be substantially equal to H. Still any height or location of forming the scores on the side walls 19 may be chosen with sound engineering judgment.

Pleats 26, and more specifically the scores 31, in the side walls 19 may be positioned spaced down from the top of the side walls 19 by a predetermined amount leaving an unscored ledge 34 at the top of the carton 10. In one embodiment, the distance from the top of the carton 10 to the first score 31*a* may be in the range between substantially zero (0) to approximately 1 inch. However, other thicknesses of the ledge 34 may be incorporated without departing from the intended scope of coverage of the embodiments of the subject invention. The first score 31*a* may fashioned on the exterior of the carton 10. Subsequently, the next score 31 may be fashioned alternatively on the inside. As depicted in FIG. 3, this causes the first pleat 26*a* to fold in to the interior of the carton 10. It will be realized that folding the pleats 26 into the carton 10 maintains the outer circumference of the carton 10 as opposed to expanding it, which may be undesirable when stacking cartons 10. The remaining scores 31 may follow in a similar pattern. In one embodiment, enough scores 31 may be fashioned to create two (2) pleats 26. However, any number of pleats 26 may be constructed in the carton 10. Additionally, scores 31 may be incorporated into the lid panels 23. More specifically, scores 31 may be fashioned in the minor panels 27 of the lid 22, which inhibits the lid panels 23 from breaking open during shipment.

Figure 4:
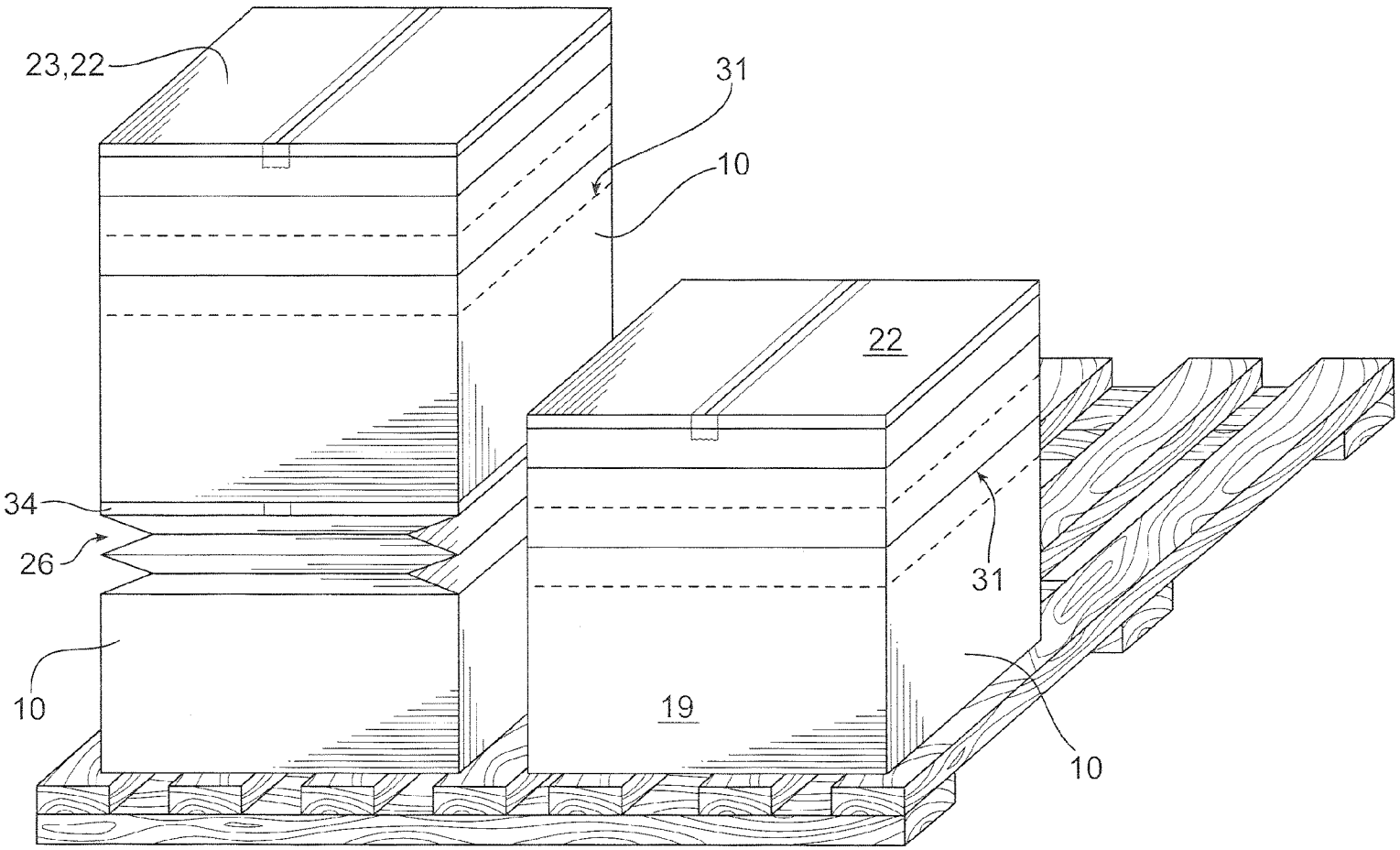
FIG. 4 is a perspective view of multiple cartons stacked together on a pallet according to the embodiments of the subject invention.
Figure 6:
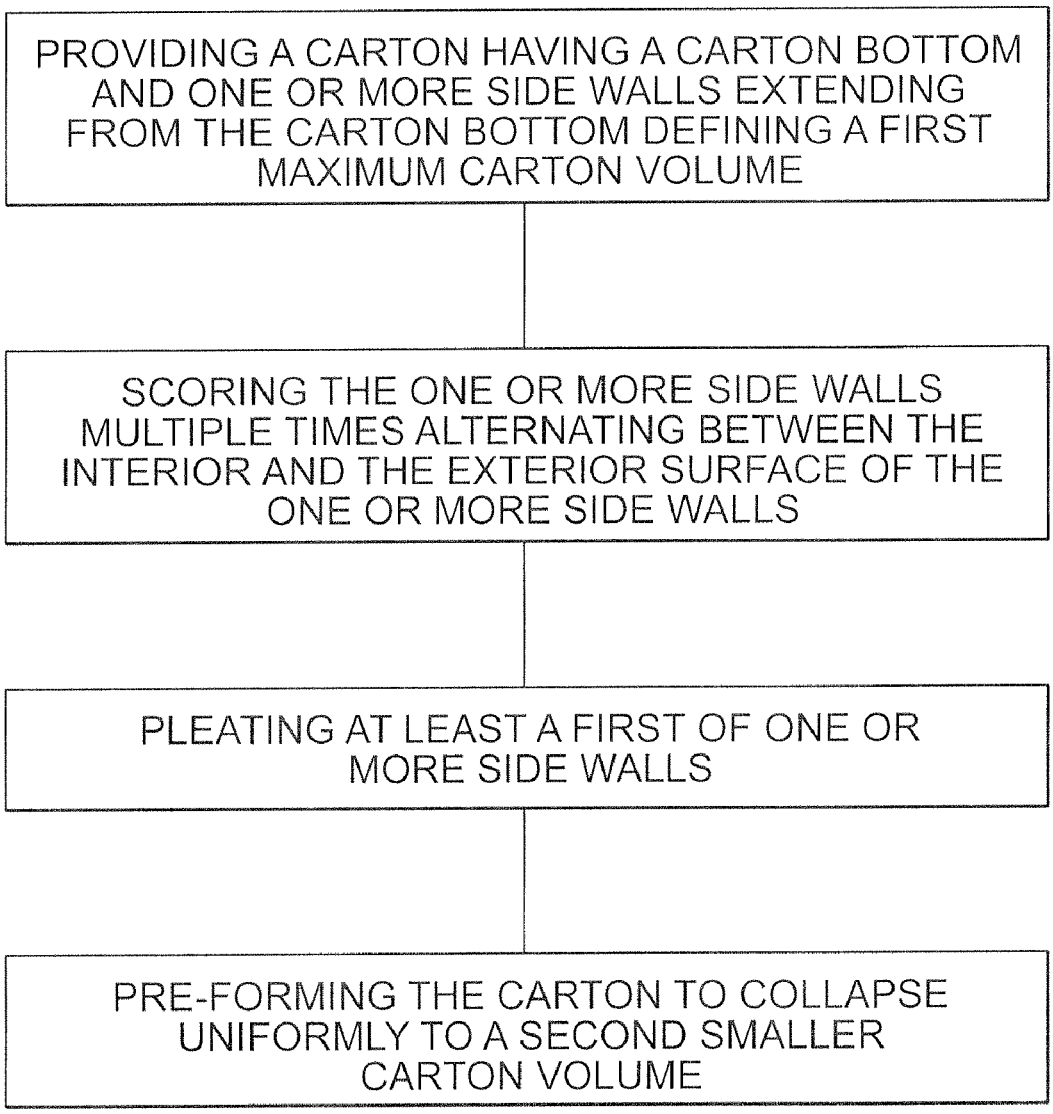
FIG. 6 is a block diagram of a method for constructing a collapsible carton to the embodiments of the subject invention.

With reference to all of the Figures and in particular FIGS. 4 and 6, assembly and use of the collapsible cartons 10 will now be described. The carton 10 may be constructed from a generally planar and contiguous piece of material, cut to the appropriate configuration for assembling the carton 10, which may include a carton bottom 16, side walls 19 and lid panels 23, including major and minor lid panels. It is to be construed that any size or shape of carton 10 may be constructed without departing from the intended scope of coverage of the embodiments of the subject invention. In one embodiment, the side walls 19 and the minor lid panels, may then be scored in any manner consistent with that described above for fashioning one or more pleats 26. After scoring, the carton 10 may then be creased, folded and glued, or otherwise fastened, together thereby creating a box-like structure, i.e. the carton 10. Tools or dies may then be utilized to pre-form the carton so that it collapses in a predetermined manner respective of the product stored therein. By pre-forming it is meant that the tools or dies bend the carton walls forcing the pleats inward or outward respective of the applied scores 31. For example, a carton 10 may be pre-filled with a certain amount of product, i.e. articles 13, or the determination may be made to fill the carton with only a certain amount of product. The amount of extra space within the carton 10 will be evident to the user or operator. Tooling may then be chosen to bend only those scored regions of the walls 19 or lid 22 that the operator intends to collapse should sufficient force be applied to the top surface of the carton 10. In this manner, the carton 10 collapses from a first maximum volume to a second smaller by a discrete amount. Pre-forming ensures that all of the scored surfaces, that the operator intends, will collapsed to together in a uniform manner. However, even if the pleats 26 are not pre-formed, the scores 31 fashioned in the carton walls will cause the carton 10 to automatically collapse in a predetermined manner. The amount of reduced volume, of course will be determined by the size of the pleats 26 and the number of pleats 26 pre-formed to automatically bend when pressure is applied. In other words, the formation of pleats 26 in the carton walls allows the carton to automatically collapse in discrete volumetric increments. After pre-forming, the carton 10 may then be filled with product and sealed for shipment to the end-user. It will be recognized that pleating, or scoring, and pre-forming the minor lid panels will prevent the lid 22 from unexpectedly popping open during transit.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A collapsible carton, comprising:

a carton bottom;

a plurality of side walls extending substantially perpendicularly from the carton bottom to defining a first maximum carton volume, wherein the carton is fashioned to automatically collapse via at least a first score under pressure in a substantially uniform manner defining a second smaller carton volume, and wherein the plurality of side walls form a top opening, the plurality of side walls include, first and second non-contiguous opposed side walls, wherein the first side wall includes a score at a predetermined height H with respect to the carton bottom; and, wherein the second side wall includes a score at substantially the same height H with respect to the carton bottom, and at least third and fourth non-contiguous opposed side walls spaced apart by the first and second side walls, wherein the third side wall includes a score at a predetermined height H1 with respect to the carton bottom and wherein the fourth side wall includes a score at substantially the same height H1 with respect to the carton bottom; wherein H1 is less than H;

a carton lid formed from a pair of major flaps and a pair of minor flaps extending from and along the width of each of the sidewalls and disposed distally from the carton bottom, wherein the carton lid is substantially perpendicular to the side walls to cover the top opening, and wherein at least one flap selected from the group consisting of the pair of major flaps and the pair of minor flaps includes a plurality of scores; and a ledge contiguous around the perimeter of the carton and disposed between the carton lid and the carton sides.

2. The collapsible carton as defined in claim 1, wherein each of the side walls respectively collapse substantially uniformly from a first height to a second shorter height.

3. The collapsible carton as defined in claim 1, wherein the carton collapses in discrete volumetric increments.

4. The collapsible carton as defined in claim 3, wherein the carton is generally polygonal; and, wherein the plurality of side walls are generally planar.

5. The collapsible carton as defined in claim 3, wherein the carton is generally tubular.

6. The collapsible carton as defined in claim 1, wherein the plurality of side walls include at least a first score extending at least partially along the width of the plurality of side walls thereby facilitating the collapse of the plurality of side walls in a substantially uniform manner.

7. The collapsible carton as defined in claim 6, wherein the plurality of side walls include a plurality of scores respectively; and, wherein the plurality of scores are each substantially parallel with respect to each other and to the carton bottom.

8. The collapsible carton as defined in claim 7, wherein the plurality of scores of each of the plurality of walls are offset vertically with respect to the plurality of scores of the adjacent side wall.

9. The collapsible carton as defined in claim 6, wherein the plurality of side walls include a plurality of scores respectively; and, wherein the plurality of scores are alternately fashioned on inner and outer surfaces of the carton thereby facilitating collapse of the carton in a pleated fashion.

10. The collapsible carton as defined in claim 9, wherein the plurality of scores of each of the plurality of walls are offset vertically with respect to the plurality of scores of the adjacent side wall.

11. The collapsible carton as set forth in claim 1, wherein the pair of minor flaps include the plurality of scores for automatically collapsing the pair of minor flaps in a pleated manner.

12. The carton as defined in claim 1, wherein the ledge is disposed between the carton lid and the side walls that have at least a vertical pleated portion.

13. The carton as defined in claim 1, wherein the ledge is un-scored.

14. A carton, comprising:

a carton bottom; and four side walls defining a first maximum carton volume, wherein the carton is fashioned to automatically collapse via at least a first score under pressure in a substantially uniform manner defining a second smaller carton volume, wherein the four side walls form a top opening, each of the four side walls is connected to the carton bottom and include:

a non-pleated section that extends from the carton bottom and contains no scores, and a pleated section that includes a plurality of scores that are each substantially parallel with respect to each other and to the carton bottom; and a carton lid formed from a plurality of panels extending from and along the width of each of the sidewalls, wherein the plurality of panels are substantially perpendicular to the four side walls to cover the top opening, and at least one panel of the plurality of panels includes a plurality of scores for automatically collapsing the at least one panel under pressure; and a ledge contiguous around the perimeter of the carton and disposed between the carton lid and the carton sides.

15. The carton as set fourth in claim 14, wherein the pleated section is disposed between the non-pleated section and the ledge.

16. The carton as defined in claim 14, wherein the plurality of scores of each of the four side walls are offset vertically with respect to plurality of scores of the adjacent side wall.

17. The carton as defined in claim 14, wherein the ledge is un-scored.

* * * * *